US006287740B2

(12) United States Patent
Ohmura et al.

(10) Patent No.: US 6,287,740 B2
(45) Date of Patent: Sep. 11, 2001

(54) TONER AND IMAGE FORMING METHOD

(75) Inventors: Ken Ohmura; Tomomi Oshiba, both of Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/767,095

(22) Filed: Jan. 22, 2001

Related U.S. Application Data

(63) Continuation of application No. 09/378,899, filed on Aug. 23, 1999, now Pat. No. 6,197,468.

(30) Foreign Application Priority Data

Aug. 26, 1998 (JP) ..... 10-240131

(51) Int. Cl.[7] ..... G03G 9/097
(52) U.S. Cl. ..... 430/108.8; 430/109.2; 430/110.4
(58) Field of Search ..... 430/109.2, 108.8, 430/110.4

(56) References Cited

U.S. PATENT DOCUMENTS 5,026,621 * 6/1991 Tsubuko et al. ..... 430/109
5,863,697 * 1/1999 Uchiyama et al. ..... 430/137
5,965,316 * 10/1999 Kmiecik-Lawrynowicz et al. .... 430/109

FOREIGN PATENT DOCUMENTS 812447 2/1996 (JP) .
962031 3/1997 (JP) .

* cited by examiner

*Primary Examiner*—John Goodrow
(74) *Attorney, Agent, or Firm*—Jordan B. Bierman; Bierman, Muserlian and Lucas

(57) ABSTRACT

A toner for electrophotography is disclosed. The toner comprises a binder resin and a colorant and a wax in amount of 0.5 to 8 percent by weight, and adhesion power index of wax particles to toner particles is between 0.7 and 2.2. The toner improves the durability of the developer material and a photoreceptor, minimizes image smear at high temperature and humidity, and exhibits excellent fixation as well as offsetting resistance.

19 Claims, No Drawings

TONER AND IMAGE FORMING METHOD

CROSS REFERENCE TO RELATED APPLICATIONS

This application is a Continuation of application Ser. No. 09/378,899, filed Aug. 23, 1999, now U.S. Pat. No. 6,197,468.

FIELD OF THE INVENTION

The present invention relates to electrophotographic toners, and specifically to the composition of toner releasing agents and friction reducing agents.

BACKGROUND OF THE INVENTION

As conventional techniques related to waxes according to the present invention, for example, Japanese Patent Publication No. 8-12447 discloses a toner comprising no more than 10 free polyethylene wax particles per 100 toner particles, which improves fixation as well as offsetting resistance. Further, the same patent discloses a production method in which melt-kneading is carried out employing a binder with a viscosity of at least 1,000 poise and describes excellent offsetting properties and fluidity, minimal staining of a toner holding body and improved cleaning properties, through the addition of polyethylene wax.

In addition, Japanese Patent Publication Open to Public Inspection No. 9-62031 discloses that in a toner for developing an electrostatic image comprising toner particles as well as low molecular weight wax particles, the melt index of said toner is at least 10; 10 to 500 of said low molecular weight wax particles are present per 10,000 toner particles, and long chain alcohols are employed as said low molecular weight wax.

However, these conventional techniques have cause problems in which in the case of employing an organic photoreceptor during blade cleaning, a toner abrades the photoreceptor to lower the sensitivity due to abrasion of the photoreceptor and to shorten the lifetime of the photoreceptor. Further, nitrates formed due to corona discharging during charging and transfer processes accumulate on the surface of the photoreceptor, and when left at high temperature and humidity, a problem occurs in which image smear is caused. Still further, along with the higher speed of roll fixing as well as lower weight load, a conventional technique in which wax is dispersed into the interior of the toner to be included has caused problems of offsetting properties due to the low bleeding rate of the wax.

SUMMARY OF THE INVENTION

Accordingly, an object of the present invention is to provide a toner which improves the durability of the developer material itself, as well as the durability of a photoreceptor. At the same time, another object is to provide a toner which minimizes image smear at high temperature and humidity. Still another object is to provide a toner which exhibits excellent fixation as well as offsetting resistance.

The aforesaid objects of the present invention are accomplished by the embodiments described below.

(1) In a toner comprising at least a binder resin and a colorant, the toner comprises a wax, composed of at least one of polypropylene wax, polyethylene wax, paraffin series wax, amide wax, and fatty acid ester wax, and further, the adhesion power index of wax to toner particles is 0.7 to 2.2. An amount of the wax is preferably 0.5 to 8 percent by weight with reference to toner. More preferably 3.8 to 7.4 percent by weight.

(2) The toner described in (1), which is characterized in that the volume average particle diameter Dw of a wax and the volume average particle diameter Dt of a toner are in a ratio of $0.5<Dw/Dt<0.9$, and the ratio of wax component having a particle diameter of 4 to 12 $\mu$m is between 50 and 85 percent, in terms of the number of particles.

(3) The toner described in (1) or (2) which is characterized in that the shape of said wax is substantially amorphous.

(4) In a toner comprising at least a binder resin as well as a colorant, an image forming method which is characterized in that employing a two-component developer material prepared by mixing with a carrier said toner, comprising at least one of polypropylene, polyethylene, paraffin wax, amide wax, and fatty acid esters, and further, having an adhesion index of 0.7 to 2.2, after a negatively charged organic photoconductor is subjected to toner development/transfer, the toner which is not transferred to a transfer material and remains on the photoreceptor is recovered employing a cleaning device in which the cleaning blade, composed of a urethane rubber material, is brought into contact with said photoreceptor at an angle counter to the direction of movement and under a contact load of 18 to 30 g/cm, and the recovered toner is repeatedly employed by returning it to the development device or toner supply device.

DETAILED DESCRIPTION OF THE INVENTION

The present invention will now be detailed below.

It has become possible to extend the lifetime of a photoreceptor in such a manner that a protective layer is formed on the surface of the photoreceptor through an appropriate supply of the wax during toner development, and the photoreceptor is thereby subjected to reduced abrasion.

It has also become possible to minimize image smear in such a manner that because fresh wax for protecting photoreceptor is constantly supplied and consumed, there occurs no accumulation of nitrate compounds which cause such image smear.

Through melt-adhesion of the wax to the carrier or the development rollers, it has become possible to minimize background stain as well as toner scatter due to insufficient charging.

When a toner contains an appropriate amount of wax, a protective layer is formed on a photoreceptor, to exhibit minimal abrasion of the photoreceptor. However, problems occur in which when excessive wax exists, streak-like image defects result due to photoreceptor filming and the melt-adhesion of the wax to the carrier or development rollers, which degrades charging function and shortens the lifetime of the developer material.

Both the minimized photoreceptor abrasion and the prevention of melt-adhesion to a toner holding body are accomplished by adjusting the adhesion power index of the wax to toner particles to the range specified in the present invention.

Furthermore, with the intention of minimizing streak-like image defects due to excessive filming on the photoreceptor, the toner of the present invention is preferably employed in an image forming method, in which the toner which is not transferred to a transfer material and remains on the photoreceptor, is brought into contact with a cleaning blade composed of an elastic material under a blade load of at least 18 g/cm.

In the present invention, the ratio of the volume average particle diameter Dw of a wax to the average volume particle diameter Dt of a toner is in the range of $0.5<Dw/Dt<0.9$. In addition, the ratio of wax components having a particle diameter of 4 to 12 μm is preferably between 50 and 85 percent in terms of the number of particles, and is more preferably between 55 and 75 percent.

Of the types of photoreceptor protection wax, a polypropylene containing wax is preferred, while a low molecular weight polypropylene containing wax is more preferred.

Wax employed in the invention is exemplified.

Paraffin wax: n-paraffin having carbon atom numbers of 20 to 36 and isoparaffin (microcrystaline wax) having carbon atom numbers of 31 to 50.

Polyethylene wax having molecular weight of 1,000 to 5,000.

Fatty acid ester:

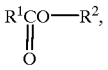

each of $R^1$ and $R^2$ is a group having carbon atom numbers of 16 to 32, preferably an alkyl or alkenyl group, more preferably an alkyl group.

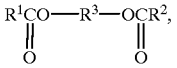

each of $R^1$ and $R^2$ is a group having carbon atom numbers of 16 to 32, preferably an alkyl or alkenyl group, more preferably an alkyl group, and $R^3$ is a group having carbon atom numbers of 1 to 32, preferably alkylene group.

Amide wax:

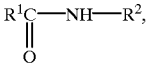

each of $R^1$ and $R^2$ is a group having carbon atom numbers of 16 to 32, preferably an alkyl or alkenyl group, more preferably an alkyl group.

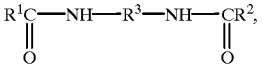

each of $R^1$ and $R^2$ is a group having carbon atom numbers of 16 to 32, preferably an alkyl or alkenyl group, more preferably an alkyl group, and $R^3$ is a group having carbon atom numbers of 1 to 32, preferably alkylene group.

In the above formulae, alkyl group may be straight or branched.

Concrete example of the amide wax includes stearic acid amide, ethylenebisstearic acid amide, methylenebisstearic acid amide, oleic acid amide, palmitic acid amide and behenic acid amide.

Preferable example of the wax includes polypropylene wax, fatty acid ester wax, paraffin wax, polyethylene wax and amide wax. Most preferable is polypropylene wax.

In the present invention, colored particles are composed of binder resins, colorants, and if desired, other dispersed additives. Those which comprise wax particles are preferred, and further, wax particles are preferably incorporated into the interior of the colored particles or buried within the same. The average particle diameter of the colored particles is generally between 2 and 15 μm in terms of volume average particle diameter, and is preferably between 3 and 9 μm. Further, the volume average particle diameter of the toner is measured employing a Coulter Counter TA-II or a Coulter Multisizer.

The toner is composed of colored particles which comprises a binder resin, colorant, wax and optionally other additives.

In the present invention, there is no particular limitation on binding resins composing the colored particles, and various types of conventional resins known in the art are employed. For example, listed are styrene series resins, acrylic series resins, styrene/acrylic series resins, polyester series resins, and the like.

Listed as other additives composing the colored particles are, for example, charge control agents such as salicylic acid derivatives, azo series metal complexes, and the like, fixability improving agents such as low molecular weight polyolefin, carnauba wax, and the like, and the like. The wax of wax particles in the present invention may be the same type as, or different from those in the fixability improving agent.

Furthermore, in the case of the preparation of a magnetic toner, magnetic material particles are incorporated as additives into the colored particles . As the magnetic material particles, employed are particles of ferrites, magnetites, and the like having an average primary particle diameter of 0.1 to 2.0 μm. The added amount of magnetic material particles is between 20 and 70 weight number in colored particles.

<Production Method of Toner>

The toner of the present invention may be produced in such a manner that, for example, a colorant and a fixability improving agent, a charge control agent are incorporate-dispersed into a binder resin by premixing and melt-kneading the resultant mixture, and after pulverization and classification, wax particles are added and mixed with the resultant, or during pulverization, wax as a fixability improving agent is released from the surface of colored particles.

The selection of a premixing apparatus, a kneading apparatus, a pulverizing and classifying apparatus, and operation conditions makes it possible to realize the production method of the latter. For example, the production can be realized in such a manner that premixing is carried out under soft conditions. Specifically, the amount of wax freed during pulverization may be adjusted while adjusting the circumferential speed of the rotating blade of the premixing apparatus.

In the present invention, optionally employed as colorants incorporated into colored particles may be carbon blacks, magnetic materials; dyes, pigments, and the like. Employed as carbon blacks are channel black, firness black agents, acetylene black, thermal black, lamp black, and the like. Employed as magnetic materials are ferromagnetic metals such as iron, nickel, cobalt, and the like, and alloys comprising such metals, ferromagnetic metal compounds such as ferrites, magnetites, and the like, and alloys which comprise no ferromagnetic metal but exhibit ferromagnetism through thermal treatment, for example, types of alloys called Hoisler alloys such as manganese-copper-aluminum, manganese-copper-tin, and chromium dioxide, and the like.

Employed as dyes may be C.I. Solvent Red 1, the same Red 49, 52, 58, 63, 111, 122; C.I. Solvent Yellow 19, the same Yellow 44, 77, 79, 81, 82, 93, 98, 103, 104, 112, and 162; and C.I. Solvent Blue 25, the same Blue 36, 60, 70, 93, and 95; and the like, and mixtures thereof.

Employed as pigments may be C.I. Pigment Red 5, the same Red 48:1, 53:1, 57:1, 122, 139, 144, 149, 166, 177, 178, and 222; Pigment Orange 31 and the same Orange 43; C. I. Pigment Yellow, the same Yellow 17, 93, 94, and 138; C.I. Pigment Green 7, C.I. Pigment Blue 15:3, the same Blue 60; and the like, and mixtures thereof.

In the present invention, employed as fixability improving agents are low molecular weight polypropylene, polyethylene, paraffin series waxes, amide series waxes, and fatty acid esters, and of these, the low molecular weight polypropylene is most preferably employed. In the measurement method of the molecular weight of polypropylene, high temperature GPC is employed and the number average molecular weight is measured. Specifically, o-dichlorobenzene, to which 0.1 percent of aionol was added as a solvent, was used, and was eluted at a temperature of 135° C., and was detected employing a differential refractive index detector. The number average molecular weight was obtained in terms of absolute molecular weight of polypropylene employing a universal calibration method.

The molecular weight of polypropylene was measured at a temperature of 135° C. and a flow rate of 1 m/minute employing GPC-150C (manufactured by WATERS Co.) in which SHODEX HT-80 was used as a column, and o-dichlorobenzene, to which 0.1 percent aionol was added, was used as a solvent.

Further, the low molecular weight polypropylene, an example of the wax, as described herein denotes one having a volume average molecular weight of not more than 18,000, preferably 800 to 18,000, and more preferably having 1,500 to 10,000.

Further, low molecular weight polyolefin series polymer which is synthesized employed a metallocene catalyst can be more preferably employed for the toner of the present invention.

In the present invention, listed as charge control agents can be negatively chargeable charge control agents such as azo series metal complexes, salicylic acid metal complexes, calixarene series compounds, and the like, and positively chargeable charge control agents such as nigrosine dyes, quaternary ammonium salt series compounds, and the like.

Employed as fine inorganic particles used as external agents may be those having a number average primary particle diameter of 10 to 500 nm. The number average primary particle diameter as described herein denotes ones which are observed when employing a transmission type electron microscope and measured by the image analysis.

Preferably employed as fine inorganic particles as the external agents are various inorganic oxides, nitrides, borates and the like. For example, listed are silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicone carbide, boron carbide, titanium carbide, silicone nitride, titanium nitride, boron nitride, and the like.

Further, the above-mentioned fine inorganic particles may be those which are subjected to hydrophobic treatment. The hydrophobic treatment is preferably carried out employing so-called coupling agents, such as various titanium coupling agents, silane coupling agents, and the like, and silicone oil, and the like. Further, the hydrophobic treatment is favorably carried out employing higher fatty acid metal salts such as aluminum stearate, zinc stearate, calcium stearate, and the like.

Titanium coupling agents include tetrabutyl titanate, tetraoctyl titanate, isopropyltriisostearoyl titanate, isopropyltridecylbenzenesulfonyl titanate, bis(dioctylpyrophosphate) oxyacetate titanate, and the like. Further, listed as silane coupling agents are γ-(2-amino ethyl) aminopropyltrimethoxysilane, gamma-(2-aminoethyl) aminopropyltrimethoxysilane, γ-(2-aminoethyl) aminopropylmethyldimethoxysilane, γ-methacryoxypropyltromethoxysilane, N-β-(N-vinylbenzylaminoethyl) γ-aminopropyltrimethoxysilane hydrochloride, hexamethyldisilazane, methyltrimethoxysilane, butyltrimethoxysilane, isobutyltrimethoxysilane, hexylmethoxysilane, octyltrimethoxysilane, decyltrimethoxysilane, dodecyltrimethoxysilane, phenyl trimethoxysilane, o-methylphenyltrimethoxysilane, p-methylphenyltrimethoxysilane, and the like.

Listed as fatty acids and metal salts thereof are long chain fatty acids such as undecylic acid, lauric acid, tridecylic acid, dodecylic acid, myristic acid, palmitic acid, pentadecylic acid, stearic acid, heptadecylic acid, arachic acid, montanic acid, oleic acid, linoleic acid, arachidonic acid and the like, and listed as salts thereof are salts formed with metals such as zinc, iron, magnesium, aluminum, calcium, sodium, lithium, and the like. Listed as silicone oils can be dimethylsilicone oil, methylphenylsilicone oil, amino-modified silicone oil, and the like.

The added amount of these compounds employed for coating fine inorganic particles is preferably between 1 and 10 percent by weight of the same particles, and is more preferably between 3 and 7 percent by weight. Further, these compounds may be employed in combination.

In the present invention, a resin-coated carrier is preferably employed. Employed resins are not particularly limited, and for example, employed may be silicone resins, fluorine-containing acrylic acid ester series resins, styrene-acrylic resins.

Preferred as styrene-acrylic resins are copolymers of styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, p-n-dodecylstyrene with methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate, and the like, and acrylic acid ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, dimethylaminoethyl acrylate, diethylaminoethyl acrylate, and the like.

Employed as carrier core particles used in the present invention may be iron powder, magnetites, and various types of ferrites. Magnetites and various types of ferrites are preferably employed.

Preferred as ferrites are those comprising heavy metals such as copper, zinc, nickel, manganese, and the like, and light metal ferrites comprising alkali metal and/or alkali earth metal. Of these, light metal ferrites comprising alkali metal and/or alkali earth metal are particularly preferred.

This carrier is comprised of alkali metal such as Li, Na, etc. and/or alkali earth metal such as Mg, Ca, Sr, Ba, etc., and has the composition as described below.

$$(M_2O)_m(Fe_2O_3)_n$$

or $$(MO)_m(Fe_2O_3)_n$$

Further, acceptable also are these in which one part of $M_2O$ and/or $Fe_2O_3$ is substituted with alkali earth metal oxides:

wherein M represents the above-cited alkali metal such as Li, Na, etc. and/or alkali earth metal such as Mg, Ca, Sr, Ba; m represents no more than 30 mole percent, and preferably no more than 18 mole percent; further, substituted alkali earth metal and/or alkali metal oxide is preferably in an amount of 1 to 10 mole percents; and is more preferably in an amount of 3 to 10 mole percent; and n represents at least 70 mole percent, and is more preferably at least 82 mole percent.

These light metal ferrites or magnetites are preferred because they exhibit advantages in which in recent years, pollution issues due to toner waste are solved and in addition, the weight of the carrier itself can be reduced, and stress due to toner can be reduced.

The preferred carrier particle diameter is between 10 and 100 $\mu$m in terms of volume average particle diameter, and is more preferably between 20 and 80 $\mu$m, and further, the preferred magnetic property is saturation magnetization of 20 to 80 emu/g.

Employed as methods to coat resins onto these core materials, may be various methods in which for example, a resin is dissolved in a solvent and the resulting solution is coated onto a core material employing a spray drying method; coating resin particles are electrostatically adhered onto a core material, and are subjected to mechanical energy to result in coating; coating resin particles are electrostatically adhered onto a core material, and are then heated above the melting point of the resin to result in melt-coating; a core material is coated by immersion; further, a resin comprising a hardener is coated and is then thermally hardened; and the like.

Further, the amount of the coating resin should be sufficient to uniformly coat the surface of the core material. The resin amount is between 0.1 and 5.0 percent by weight of the core material, and is preferably between 0.5 and 3.0 percent by weight. When the resin amount is small, the effects cannot be sufficiently exhibited, while when the resin is excessive, the resin itself may be released from the material to occasionally result in image defects.

The measurement method of the adhesion power index in the present invention will be described below.

(1) Preparation of a Surface Active Agent Solution

Water is placed in 100 ml of a measuring flask. One ml of 12% aqueous sodium dodecylbenzenesulfonate solution is measured and placed in the flask. The total volume is then adjusted to 100 ml by slowly adding water so as not to form bubbles.

(2) Suspension of Toner

Placed in 50 ml of a glass screw top bottle are 15 g of toner and 30 ml of the solution are gradually poured. After sealing the bottle with its topper, the bottle is shaken.

(3) Centrifugation 50 ml of toner suspension is placed in a centrifugal tube, which is set in an angle rotor with a rotation radius of 70 mm and is subjected to centrifugation for 20 minutes.

(4) Separation of Supernatant Solution

The wax particles adhered on the interior wall of the centrifugal tube were washed with a supernatant solution which was poured on them employing a pipette. The supernatant solution is then separated and collected. At the time, when the toner which has been precipitated is included in the supernatant solution, the toner suspension is left undisturbed in the sample tube for one day or the resulting supernatant solution is subjected to centrifugation.

(5) Measurement of Adhesion Index of Wax-Particles to Toner Particles

The adhesion index is obtained by measuring the absorbance of the supernatant solution at 500 nm.

Preferable adhesion index is 0.7 to 2.1, more preferably, 0.9 to 1.7.

The volume average particle diameter Dw of wax particles and the volume average particle diameter Dt of toner particles in the present invention will be described below.

Dw is obtained by measuring the supernatant solution after centrifugation, employing a Coulter multisizer (manufactured by Coulter Co.). Dt is obtained by measuring the toner particles, also employing a Coulter multisizer. Dw/Dt is then calculated.

Furthermore, the shape of wax particles is preferably amorphous except for spherical or ellipsoidal shapes. The polypropylene adhered on the interior wall of the centrifugal tube was observed employing a field-effect scanning type electron microscope (JSM-6400F, manufactured by Nippon Denshi) at an acceleration voltage of 5 kV and a magnification of 7,000 times. Under the above conditions, 1,000 freed propylene particles were observed and those particles which contain no more than 150 of either spherical or ellipsoidal particles were judged to be amorphous.

Toner of the present invention may include a case of being employed as a single component toner into which a magnetic material is incorporated, a case of being employed as a two-component toner with which a so-called carrier is mixed, and a case in which a non-magnetic toner is individually employed, and the like, and the toner in any of these cases may be employed. However, the method in which a carrier is mixed and employed as the two-component developer material is most preferable with the intention of realizing practical toner recycling.

The toner of the present invention is most preferably employed in the image forming method in which employing a two-component developer material with which a carrier is mixed, the toner, which is not transferred to a transfer material and remains on a photoreceptor, is recovered employing a cleaning device, and the recovered toner is returned to a development device or a toner supplying device and reused.

Further, in the present invention, polyurethane rubber, which is conventionally well known in the art, can be widely employed as a cleaning blade.

The toner of the present invention is most preferably employed for an organic photoreceptor. In the photoreceptor, pigments, as represented by the examples described below, are employed as a charge generating material (CGM):

(1) azo pigments such as monoazo pigments, bisazo pigments, triazo pigments, metal complex azo pigments, and the like
(2) perylene pigments such as perylenic acid anhydride, perylenic acid imide, and the like
(3) polycyclic quinone pigments, such as anthraquinone derivatives, anthoanthrone derivatives, dibenzpyrenequinone derivatives, pyranthrone derivatives, violanthrone derivatives, isoviolanthrone derivatives, and the like
(4) indigoid pigments such as indigo derivatives, thioindigo derivatives, and the like
(5) phthalocyanine pigments such as metal phthalocyanines, metal-free phthalocyanines, and the like So-called charge generating materials will now be detailed. The charge generating materials which are preferably employed in the present invention include polycyclic quinone pigments and more preferably dibromoanthoanthrone described in Japanese Patent Publication Open to Public Inspection No. 59-184353 or bisazo pigments described in Japanese Patent Publication Open to Public Inspection No. 2-20877 and more preferably fluorenone-type bisazo pigments represented by general formula [III] described in the same patent specification, halogen-substituted type perylene series pigments described in Japanese Patent Publication No. 3-26384, asymmetrical perylene series pigments described in Japanese Patent Publication Open to Public Inspection No. 62-54267, perylene series pigments described in Japanese Patent Publication Open to Public Inspection Nos. 54-126036, 58-152247, 59-31957, 2-251858, 4-62560, and 5-6014, and bisimidazopirydonoperylene series pigments described in Japanese Patent Application No. 3-279764.

Furthermore, these charge generating materials preferably include α-type titanyl phthalocyanine described in Japanese Patent Publication Open to Public Inspection No. 61-239248 mention, β-type titanyl phthalocyanine described in Japanese Patent Publication Open to Public Inspection No. 62-67094, C-type titanyl phthalocyanine described in Japanese Patent Publication Open to Public Inspection No. 63-366, I-type titanyl phthalocyanine described in Japanese Patent Publication Open to Public Inspection No. 2-309362, and more preferably Y-type titanyl phthalocyanine described in Japanese Patent Publication Open to Public Inspection No. 62-173640.

Listed as binders employed in the charge generating layer of the present invention may be, for example, those described below.

(1) polyesters
(2) methacrylic resins
(3) acrylic resins
(4) polyvinyl chloride
(5) polyvinylidene chloride
(6) polystyrenes
(7) polyvinyl acetate
(8) styrene copolymer resins (for example, styrene-butadiene copolymers, styrene-methyl methacrylate copolymers)
(9) acrylonitrile series copolymer resins (for example, vinylidene chloride-acrylonitrile copolymer and the like)
(10) vinyl chloride-vinyl acetate copolymers
(11) chloroethylene-vinyl acetate-maleic anhydride copolymers
(12) silicone resins
(13) silicone-alkyd resins
(14) phenol resins (for example, phenol-formaldehyde resins, creosol-formaldehyde resins)
(15) styrene-alkyd resins
(16) poly-N-vinyl carbazole
(17) polyvinyl butyral
(18) polyvinyl formal
(19) polyhydroxystyrene These binders may be employed individually or in combination of two or more types.

Generally a charge transport layer includes a charge transport material, which is not particularly limited. Listed as examples of charge transport materials are oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline derivatives, amine derivatives, oxazolone derivatives, benzothiazole derivatives, benzimidazole derivatives, quinazoline derivatives, benzofuran derivatives, acridine derivatives, phenazine derivatives, aminostilbene derivatives, poly-N-vinyl carbazole, poly-1-vinylpyrene, and poly-9-vinyl anthracene.

In the present invention, as binders in the charge transport layer, the above-mentioned binders employed in the charge generating layer may be employed in addition to polycarbonate resins. Furthermore, a charge transport layer is dissolved in the above-mentioned organic solvents and is applied onto the charge generating layer.

Furthermore, the photoreceptor of the present invention may comprise UV absorbers and the like to protect the photosensitive layer, and may comprise dyes for correcting spectral sensitivity.

Furthermore, in the present invention, an interlayer may be provided between the base body and the charge generating layer. Said interlayer functions as an adhesion layer, a blocking layer, or the like. Employed in addition to the above-cited binder resins, can be, for example, polyvinyl alcohol, ethyl cellulose, carboxymethyl cellulose, vinyl chloride-vinyl acetate copolymers, vinyl chloride-vinyl acetate-maleic anhydride copolymers, casein, alcohol-soluble nylon, starch, and the like.

In the image forming method of the present invention, the toner according to the present invention is employed in the two-component developer material; after carrying out toner development/transfer employing an organic photoreceptor, the toner, which is not transferred to the transfer material and remains on the photoreceptor, is recovered employing a cleaning device in which the cleaning blade, composed of a urethane rubber material is brought into contact with the said photoreceptor at an angle counter to rotation and at a contact load of 18 to 30 g/cm; the recovered toner is returned to the development device or the toner supplying device and is preferably reused.

The above-mentioned image forming method results in suitable formation of a photoreceptor protecting layer formed by a wax and exhibits effects in which the usual problems with abrasion and filming of a photoreceptor are solved. Furthermore, the toner of the present invention is most preferably employed in a fixing device in which the line speed is at least 300 mm/second at heat roll fixing or fixing load to a transfer sheet is no more than 3.0.

EXAMPLES

The present invention is described below with reference to examples. Incidentally, "part" described hereinafter indicates "weight part".

| <Carrier Preparation> | |
|---|---|
| Core particles (ferrite particles with a volume average particle diameter of 70 μm) | 1000 parts |
| Resin particles (1,1,1-trifluoroethyl methacrylate with a volume average particle diameter of 0.1 μm) | 20 parts |

Carrier "C-1" was prepared by placing the above-cited carrier raw materials in a horizontal rotation blade type mixer, heating the mixture to 70 ° C. while mixing at a peripheral speed of the rotation blade of 4 m/second and by mixing the resulting mixture further for 20 minutes.

| <Preparation of Colored Particles><br><Color Particles 1> | |
|---|---|
| Binder resin: polyester resin | 100 parts |
| Colorant: Morgal L (manufactured by Cabbot Co.) | 9 parts |
| Releasing agent: polypropylene (Mw 6600, Mn 3000, Mw/Mn = 2.2, Tm 80° C.) | 5 parts |

Colored Particles 1 with a volume average particle diameter of 10.0 $\mu$m were prepared by mixing these raw materials, followed by kneading, crushing, pulverizing, and classifying the resulting mixture employing the apparatuses described below. Preliminary mixing was carried out for 5 minutes while controlling the mixing conditions so as to result in the physical properties described in Tables 1 and 2.

Preliminary mixing: Redige mixer (crushing blade OFF)

Kneading: biaxial kneading extruder

Crushing: hammer mill

Pulverizing: jet system pulverizer

Classifying: pneumatic classifier

| <Colored particles 2> | |
|---|---|
| Binder resin: polyester resin | 100 parts |
| Colorant: Morgal L (manufactured by Cabbot Co.) | 9 parts |
| Releasing agent: polypropylene (Mw 13700, Mn 7200, Mw/Mn = 1.9, Tm 133° C.) | 6 parts |

Colored Particles 2 with a volume average particle diameter of 9.0 $\mu$m were prepared by mixing these raw materials, followed by kneading, crushing, pulverizing, and classifying the resulting mixture employing apparatuses described below. Preliminary mixing was carried out for 5 minutes while controlling the mixing conditions so as to result in the physical properties described in Tables 1 and 2.

Preliminary mixing: Redige mixer (crushing blade OFF)

Kneading: biaxial kneading extruder

Crushing: hammer mill

Pulverizing: rotor-type pulverizer

Classifying: pneumatic classifier

| <Colored Particles 3> | |
|---|---|
| Binder resin: polyester resin | 100 parts |
| Colorant: Morgal L (manufactured by Cabbot Co.) | 10 parts |
| Releasing agent: polypropylene (Mw 13700, Mn 7200, Mw/Mn = 1.9, Tm 133° C.) | 6 parts |

Colored Particles 3 with a volume average particle diameter of 8.0 $\mu$m were prepared by mixing these raw materials, followed by kneading, crushing, pulverizing, and classifying the resulting mixture employing apparatuses described below. Preliminary mixing was carried out for 5 minutes while controlling the mixing conditions so as to result in the physical properties described in Tables 1 and 2.

| <Colored Particles 4> | |
|---|---|
| Binder resin: polyester resin | 100 parts |
| Colorant: Morgal L (manufactured by Cabbot Co.) | 10 parts |
| Releasing agent: polypropylene (Mw 8600, Mn 2270, MW/Mn = 3.8, Tm 135° C.) | 4 parts |

Colored Particles 4 with a volume average particle diameter of 10.0 $\mu$m were prepared by mixing these raw materials, followed by kneading, crushing, pulverizing, and classifying the resulting mixture employing apparatuses described below. Preliminary mixing was carried out for 5 minutes while controlling the mixing conditions so as to result in the physical properties described in Tables 1 and 2.

Preliminary mixing: Henschel mixer

Kneading: biaxial kneading extruder

Crushing: hammer mill

Pulverizing: jet system pulverizer

Classifying: pneumatic classifier

<Colored Particles 5>

Colored Particles 5 were prepared in the same manner as Colored Particles 4, except that mixing matter was controlled so as to result in the physical properties as described in Tables 1 and 2.

<Colored Particles 6>

Colored Particles 6 was prepared in the same manner as Colored Particles 4, except that mixing conditions were controlled so as to result in the physical properties as described in Tables 1 and 2.

Table 1 shows the standing bulk density and variation ratio of preliminary mixtures, and Table 2 shows the particle distribution variation of preliminary mixtures. Further, the blending uniformity of raw materials was varied by changing preliminary mixing intensity, and the amount of polypropylene released from the toner during crushing was controlled.

TABLE 1

| | Standing Bulk Density | | |
|---|---|---|---|
| Type of Colored Particles | Mixing for 1 Minute ($g/cm^3$) | Mixing for 5 Minutes ($g/cm^3$) | Variation Ratio (%) |
| Colored Particles 1 | 0.609 | 0.602 | 98.9 |
| Colored Particles 2 | 0.589 | 0.588 | 99.8 |
| Colored Particles 3 | 0.556 | 0.554 | 99.6 |
| Colored Particles 4 | 0.651 | 0.659 | 101.1 |
| Colored Particles 5 | 0.610 | 0.619 | 101.5 |
| Colored Particles 6 | 0.596 | 0.608 | 102.0 |

TABLE 2

| Sieve Opening (μm) | Mixing Time: Mixing for 1 Minute 250 | 150 | 75 | 45 | 20 | Mixing for 5 Minutes 250 | 150 | 75 | 45 | 20 |
|---|---|---|---|---|---|---|---|---|---|---|
| Colored Particles 1 | 59.0 | 18.8 | 20.9 | 1.2 | 0.1 | 56.2 | 17.5 | 24.9 | 1.4 | 0 |
| Colored Particles 2 | 61.4 | 17.0 | 18.4 | 3.1 | 0.1 | 62.9 | 17.3 | 16.4 | 3.2 | 0.2 |
| Colored Particles 3 | 59.9 | 17.3 | 19.5 | 3.2 | 0.1 | 59.5 | 16.9 | 20.5 | 3.1 | 0 |
| Colored Particles 4 | 68.8 | 14.5 | 12.4 | 4.1 | 0.1 | 68.2 | 7.2 | 16.8 | 7.5 | 0.3 |
| Colored Particles 5 | 70.9 | 15.5 | 10.4 | 3.1 | 0.1 | 70.3 | 6.6 | 16.2 | 6.8 | 0.1 |
| Colored Particles 6 | 69.6 | 16.5 | 11.1 | 2.7 | 0.1 | 69.4 | 10.5 | 14.2 | 5.8 | 0.1 |

Toners Examples 1 through 3 and Comparative Examples 1 through 3 shown in table 3 below were prepared by mixing 100 parts of each of Colored Particles 1 through 6 with 1.0 part of hydrophobic silica as a fine metal oxide powder, employing a Henschel mixer (operated at 40 m/second). In Examples 4 through 6, were mixed 0.01 part of wax particles, and 1.0 part of hydrophobic silica employing a Henschel mixer (operated at 26 m/second).

Developer materials for evaluation were prepared by mixing Toners 1 through 3 and Comparative Toners 1 through 3 shown in Table 3 with Carrier C-1 so that the concentration of Toner became 5 percent by weight.

(Evaluation Criteria)

1. Photoreceptor Abrasion

In a commercially available electrophotographic copier (the cleaning blade load of a KONICA 1015 was modified to 20.6 g/cm), practical copying evaluation was carried out at a rate of 500 sheets per day under the ambient conditions of 30° C. and RH 82% employing an original having a black area ratio of 5 percent. The photoreceptor abrasion was obtained by subtracting the layer thickness of the photoreceptor from the initial thickness thereof after copying 50,000 sheets 2. Lifetime of Photoreceptor The lifetime of the photoreceptor was evaluated depending on the number of sheets when stain density (relative density of the non-image part against a transfer sheet of paper) exceeded 0.01 upon maximizing the exposure amount. The stain density was measured employing a Densitometer PDA-65 (manufactured by KONICA CORP.).

3. Image Smear

Every morning, a first copy was prepared employing an original composed of fine lines and was evaluated. The evaluation was carried out depending on the number of copies when the image smear was detected.

TABLE 3

| Example | Colored Particles | Photoreceptor Protecting Wax Particle | Wax Adhesion Power Index | Mixing Method of Photoreceptor Protecting Wax Particles | Shape | Dw | Dt | Dw/Dt | Photoreceptor Protecting Wax 4 to 12 μm (% in number) |
|---|---|---|---|---|---|---|---|---|---|
| 1 | 1 | polypropylene | 2.1 | Released from Colored Particles during Crushing | amorphous | 6.5 | 10 | 0.65 | 63 |
| 2 | 2 | polypropylene | 1.3 | Released from Colored Particles during Crushing | amorphous | 6.7 | 9 | 0.74 | 58 |
| 3 | 3 | polypropylene | 0.7 | Released from Colored Particles during Crushing | amorphous | 7.2 | 8 | 0.9 | 52 |
| 4 | 4 | polypropylene | 1.8 | Added to colored particles and mixed employing Henschel mixer | amorphous | 6.8 | 10 | 0.68 | 59 |
| 5 | 5 | paraffin wax | 1.0 | Added to colored particles and mixed employing Henschel mixer | spherical | 6.7 | 9 | 0.74 | 57 |
| 6 | 6 | fatty acid ester wax | 0.9 | Added to colored particles and mixed employing Henschel mixer | spherical | 7.0 | 8 | 0.88 | 53 |
| Comparative Example1 | 4 | polypropylene | 0.4 | Separated from colored particles during crushing | spherical | 4.8 | 10 | 0.48 | 33 |
| Comparative Example2 | 6 | polypropylene | 0.2 | Separated from colored particles during crushing | ellipsoid of revolution | 3.8 | 9 | 0.42 | 14 |
| Comparative Example3 | 6 | polypropylene | 0.1 | Separated from colored particles during crushing | ellipsoid of revolution | 9.4 | 8 | 1.12 | 35 |

4. Lifetime of Developer Material

The charge amount of the developer material was measured employing a blow-off method known in the art. The evaluation was carried out depending on the number of copies when decreased to 10 $\mu$C/g.

5. Offsetting Resistance

The temperature range in which no offsetting resulted was measured when passing sheets through a fixing device set at a fixing line speed of 400 m/second, a nip width of 6.5 mm and a fixing load to the transfer sheet of 1.8 Kg/cm$^2$.

Table 4 shows the obtained results.

TABLE 4

| Sample | Colored Particles | Photoreceptor Abrasion | Lifetime of Photoreceptor | Lifetime of Developer Material | Image Smear | Offsetting Resistance |
|---|---|---|---|---|---|---|
| Example 1 | 1 | 2.4 | exceeding 200,000 sheets | 100,000 sheets | no formation until 200,000 sheets | 160–230° C. |
| Example 2 | 2 | 1.8 | exceeding 200,000 sheets | 80,000 sheets | no formation until 200,000 sheets | 160–230° C. |
| Example 3 | 3 | 2.2 | exceeding 200,000 sheets | 80,000 sheets | no formation until 200,000 sheets | 160–230° C. |
| Comparative Example 1 | 4 | 8.4 | 90,000 sheets | 40,000 sheets | formed at 20,000 sheets | 180–190° C. |
| Comparative Example 2 | 5 | 9.6 | 60,000 sheets | 60,000 sheets | formed at 40,000 sheets | 180–190° C. |
| Comparative Example 3 | 6 | 8.8 | 80,000 sheets | 50,000 sheets | formed at 60,000 sheets | 180–190° C. |
| Example 4 | 4 | 2.2 | exceeding 200,000 sheets | 80,000 sheets | no formation until 200,000 sheets | 150–240° C. |
| Example 5 | 5 | 6.1 | 160,000 sheets | 80,000 sheets | formation at 150,000 sheets | 140–230° C. |
| Example 6 | 6 | 5.4 | 150,000 sheets | 80,000 sheets | formation at 140,000 sheets | 140–230° C. |

As can clearly be seen from Table 4, it is found that according to toners of Examples 1 through 6, the photoreceptor abrasion is minimal and the lifetime of the photoreceptor and developer material is markedly improved compared to comparative toners obtained by the conventional method.

As verified in the Examples, according to the present invention, a toner has been obtained which minimizes photoreceptor abrasion, and improves the lifetime of the photoreceptor and developer material, reduces image smear, and improves offsetting resistance, compared to conventional toners.

What is claimed is:

1. A toner comprising a binder resin, a colorant and a wax wherein the wax is comprised of at least one of polypropylene, polyethylene, paraffin wax, amide wax and fatty acid ester wax and adhesion power index of wax to toner particles is 0.7 to 2.2.

2. The toner of claim 1, wherein amount of the wax is 0.5 to 8 percent by weight with reference to toner.

3. The toner of claim 1, wherein volume average particle diameter (Dw) of a wax and volume average particle diameter (Dt) of a toner are in a ratio of $0.5<Dw/Dt<0.9$, and the ratio of wax component having a particle diameter of 4 to 12 $\mu$m is between 50 and 85 percent, in terms of the number of particles.

4. The toner of claim 3, wherein the ratio of wax component having a particle diameter of 4 to 12 $\mu$m is between 55 and 75 percent in terms of the number of particles.

5. The toner of claim 3, wherein an average particle diameter of toner particle is 2 to 15 $\mu$m.

6. The toner of claim 1, wherein the binding resin is styrene resin, acrylic resin, styrene/acrylic resin or polyester resin.

7. The toner of claim 1, wherein the wax is low molecular weight polypropylene.

8. The toner of claim 1, wherein adhesion power index of wax to toner particles is 0.9 to 1.7.

9. The toner of claim 2, wherein amount of the wax is 3.8 to 7.4 percent by weight with reference to toner.

10. The toner of claim 1, wherein the shape of said wax is substantially amorphous.

11. The toner of claim 7, wherein an amount of low molecular weight polypropylene is 0.5 to 8 percent by weight.

12. The toner of claim 11, wherein an average volume molecular weight of the low molecular weight polypropylene is not more than 18,000.

13. The toner of claim 2, wherein volume average particle diameter (Dw) of a wax and volume average particle diameter (Dt) of a toner are in a ratio of $0.5<Dw/Dt<0.9$, the ratio of wax component having a particle diameter of 4 to 12 $\mu$m is between 50 and 85 percent, in terms of the number of particles, and the wax is low molecular weight polypropylene.

14. The toner of claim 13, wherein the ratio of wax component having a particle diameter of 4 to 12 $\mu$m is between 55 and 75 percent in terms of the number of particles.

15. The toner of claim 14, wherein adhesion power index of wax to toner particles is 0.9 to 1.7.

16. A developer comprising a toner and a resin coated carrier, said toner comprising a binder resin, a colorant, and a wax, wherein the wax is comprised of at least one of polypropylene, polyethylene, paraffin wax, amide wax and fatty acid ester wax in amount of 0.5 to 8 percent by weight of said toner and adhesion power index of wax to toner particles is 0.7 to 2.2.

17. The developer of claim 13, wherein the carrier comprises a magnetite or a ferrite comprising alkali metal and/or alkali earth metal which is coated with silicon resin, fluorinated acrylate resin or styrene acryl resin, and the wax comprises polypropylene.

18. The toner of claim 15 wherein the low molecular weight polypropylene has a volume average molecular weight of not more than 18,000.

19. The developer of claim 16 wherein the wax is low molecular weight polypropylene.

* * * * *